United States Patent [19]

Sugita

[11] Patent Number: 4,702,285

[45] Date of Patent: Oct. 27, 1987

[54] WEFT INSERTION CONTROL METHOD AND DEVICE FOR CARRYING OUT THE SAME

[75] Inventor: Katsuhiko Sugita, Kanazawa, Japan

[73] Assignee: Tsudakoma Corp., Kanazawa, Japan

[21] Appl. No.: 849,077

[22] Filed: Apr. 4, 1986

[30] Foreign Application Priority Data

Apr. 5, 1985 [JP] Japan ..... 60-71157

[51] Int. Cl.[4] ..... D03D 47/36; B65H 51/20

[52] U.S. Cl. ..... 139/452; 242/47.01

[58] Field of Search ..... 139/452; 242/47.01, 242/47.12, 47.13

[56] References Cited

U.S. PATENT DOCUMENTS

| | | | |
|---|---|---|---|
| 4,446,893 | 5/1984 | Gunneman et al. | 139/11 |
| 4,450,753 | 5/1984 | Basrai et al. | 91/35 |
| 4,458,726 | 7/1984 | Wenig | 139/11 |
| 4,530,381 | 7/1985 | Takegawa | 139/452 |
| 4,541,462 | 9/1985 | Tholander | 139/452 |
| 4,550,876 | 5/1984 | van Mullekom | 139/435 |
| 4,556,088 | 12/1985 | Tanaka et al. | 139/452 |
| 4,586,543 | 5/1986 | Volland et al. | 139/452 |

FOREIGN PATENT DOCUMENTS

| | | | |
|---|---|---|---|
| 57-29640 | 2/1982 | Japan . | |
| 0151342 | 8/1985 | Japan | 139/452 |

*Primary Examiner*—Harvey C. Hornsby
*Assistant Examiner*—Joseph S. Machoga
*Attorney, Agent, or Firm*—Flynn, Thiel, Boutell & Tanis

[57] ABSTRACT

A weft insertion control method for controlling the operation of a weft inserting device which measures and reserves a weft by winding the weft on a stationary measuring and reserving drum by means of a rotary yarn guide, releases the weft from and detains the same on the measuring and reserving drum by reciprocating a detaining pin to the measuring and reserving drum, and picks the weft wound and reserved on the measuring and reserving drum by a picking nozzle, including a detaining pin driving process in which a present weft releasing angle and a reference weft detaining angle are compared with the phase angle the loom, the detaining pin is retracted at the weft releasing angle to separate the detaining pin from the circumference of the measuring and reserving drum and the detaining pin is advanced at the reference weft detaining angle to bring the detaining pin into abutment with the circumference of the measuring and reserving drum; a detecting process in which the number of winds of the weft unwound from the measuring and reserving drum is detected; a comparing process in which the phase angle where the last wind of the weft is unwound from the measuring and reserving drum is compared with the reference weft detaining angle to obtain the angular difference therebetween; and a correcting process in which the reference weft detaining angle is corrected on the basis of the angular difference obtained in the comparing process so that the angular difference is reduced to zero. When the weft inserting speed approaches the limit of the control range, an alarm signal is produced, if necessary, to notify the abnormal condition and the weft inserting speed is adjusted to a target speed by the weft inserting speed control means to achieve further stable control of the weft inserting operation.

5 Claims, 2 Drawing Figures

WEFT INSERTION CONTROL METHOD AND DEVICE FOR CARRYING OUT THE SAME

BACKGROUND OF THE INVENTION

1. Field of the Invention

The present invention relates to a drum type weft inserting device for shuttleless looms and, more particularly, to techniques for automatically controlling the weft detaining timing of a weft detaining pin.

2. Description of Related Art

In a drum type weft inserting device, a rotary yarn guide draws out a weft from a yarn package and winds the weft around the outer circumference of a stationary measuring and reserving drum to measure and reserve the weft having a length sufficient for one weft insertion cycle, and a weft detaining pin is moved toward and away from the drum to detain the weft on the outer circumference of the drum and to release the weft wound on the drum for weft insertion, respectively. Upon the release of the weft from the detaiing pin, a picking nozzle spouts a pressurized fluid along the shuttle path into the shed to insert the weft having a measured length into the shed.

Rotative driving means for driving the rotary yarn guide and reciprocative driving means for advancing and retracting the detaining pin, such a cam mechanism, are interlocked mechanically with the crankshaft of the loom in order to operate the rotary yarn guide and the detaining pin synchronously with the principal motion of the loom.

In sequentially inserting a plurality of different wefts by using a plurality of weft inserting device, the detaining pins need to cease from motion sequentially at regular or irregular intervals according to the sequence of insertion of the different wefts, which requires intermittent disconnection of the detaining pins from the cyclic principal motion of the loom. However, the mechanical interlocking means is unable to disconnect the detaining pins intermittently or at irregular intervals, so that optional weft insertion is impossible. Moreover, since the reciprocating speed of the mechanically controlled detaining pin is limited, the reciprocation of the detaining pin becomes unstable when the loom is operated at a high speed.

Such a problem can be solved by driving the rotary yarn guide by an individual motor and by driving the detaining pin by an individual driving device, such as an electromagnetic device, instead of driving the rotary yarn guide and the detaining pin by the crankshaft of the loom through a mechanical interlocking mechanism.

In practical weaving operation, however, the weft inserting speed varies due to the variation of the related factors, such as the tension of the weft in winding the same on the measuring drum. Therefore, the length of the inserted wefts varies when the timing of reciprocation of the detaining pin is fixed.

A weft clamp controller to prevent the insertion of wefts having an excessive or deficient length is disclosed in Unexamined Japanese Patent Publication No. 57-29640. This weft clamp controller controls a weft clamp on the basis of the actual length of the weft unwound from the measuring drum detected by an optical sensor provided on the measuring drm. This invention is very effective only if the optical sensor functions correctly. However, the weft passes the optical sensor in a very short time and the optical sensor is liable to malfunction when waste flies across the optical sensor or when intensive external light enters the optical sensor. Consequently, incomplete or unstable weft insertion results.

SUMMARY OF THE INVENTION

Accordingly, it is an object of the present invention to provide, through the improvement of the above-mentioned prior invention, a device capable of automatically correcting the detaining timing of the detaining pin according to the actual condition of weft inserting operation.

It is another object of the present invention to provide a device capable of preventing erroneous correction of the detaining timing when the possibility of malfunction of the weft length detector is predicted.

According to the present invention, the number of winds of the weft unwound from the measuring drum is detected by an optical sensor, the timing of unwinding the last wind of the weft and a predetermined reference detaining timing are compared, and then the reference detaining timing is corrected on the basis of the time difference between the timing of unwinding the last wind of the weft and the predetermined reference detaining timing. Thus, the detaining timing of the detaining pin is corrected automatically according to the actual weft inserting speed. Consequently, stable weft measuring and reserving operation is achieved and the insertion of the weft having an incorrect length is prevented. Furthermore, when the optical sensor provides false information, namely, a signal of a number of pulses greater or smaller than the number of winds of the weft necessary for one weft inserting operation, the correction of the detaining timing is not executed to ensure the prevention of the erroneous correction. Thus, a control unit regulates the detaining timing of the detaining pin at an appropriate timing for every cycle or for every several cycles of operation of the loom.

Basically, an optical sensor employed in the present invention is the same as the optical sensor employed in the above-mentioned prior invention in the probability of malfunction. However, since the control unit does not execute a series of corrective procedures when the number of pulses of the detection signal is greater or smaller than a predetermined number, the frequency of malfunction of the optical sensor is reduced to the least extent. Since the false signal provided by the optical sensor through malfunction is ignored as invalid, the malfunction of the control system is prevented surely to achieve stable control functions.

Thus, the detaining timing of the detaining pin is corrected according to the actual weft inserting condition to establish an appropriate detaining timing. On the other hand, when the value of the correction is as great as the limit of the range of correction, weft inserting speed control means adjusts the weft inserting speed, and thereby the weft inserting motion is adjusted so as to match the principal motion of the loom, namely, the shedding motion and beating motion, for stable weft insertion. However, the excessive adjustment of the weft inserting speed will affect adversely the principal motion of the loom. Accordingly, the range of adjustment of the weft inserting motion is predetermined so that the principal motion of the loom is carried out normally. When the weft inserting speed approaches the limit of the control range, an alarm signal is produced, if necessary, to notify the abnormal condition and the weft inserting speed is adjusted to a target speed by the weft inserting speed control means to achieve further stable control of the weft inserting operation.

The above and other objects, features and advantages of the present invention will become more apparent from the following description of the preferred embodiment thereof when taken in conjunction with the accompanying drawings.

DESCRIPTION OF THE PREFERRED EMBODIMENT

Figure 1:
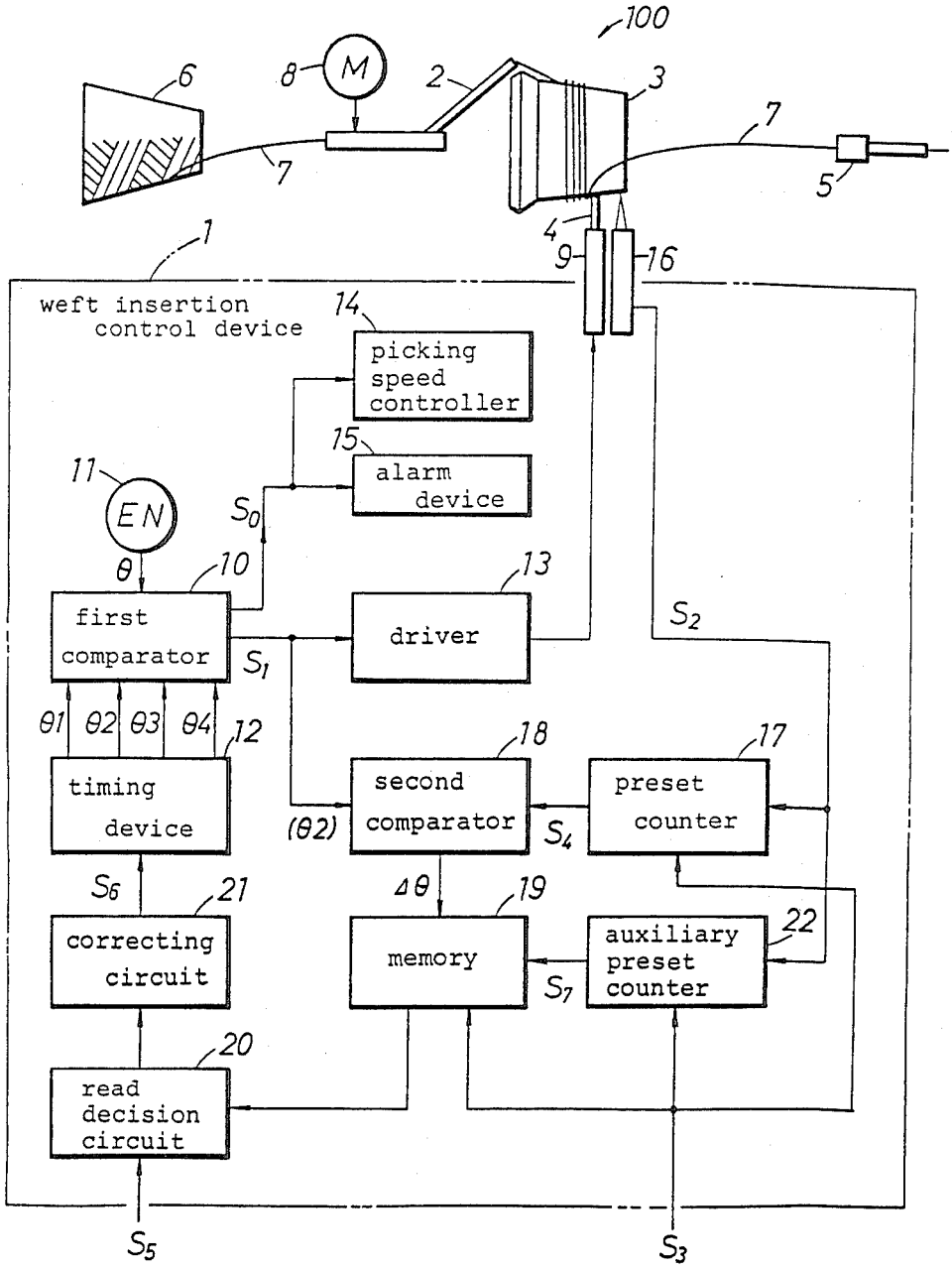
FIG. 1 is a block diagram of a weft insertion control device according to the present invention.

FIG. 1 illustrates the constitution of a weft insertion control device 1 according to the present invention and the consitution of a weft inserting device 100 to be controlled by the weft insertion control device 1. The weft inserting device 100 comprises, as the principal mechanical components, a rotary yarn guide 2, a measuring and reserving drum 3, a detaining pin 4, a picking nozzle 5, an individual motor 8 and a solenoid 9. The rotary yarn guide 2 is driven by the individual motor 8 to draw out a weft 7 from a yarn package 6 and to wind the weft 7 on the stationary measuring and reserving drum 3. The detaining pin is driven by the solenoid 9 so as to engage the circumference of the drum 3 to detain the weft 7 when the weft 7 is being measured and wound on the drum 3. In inserting the weft 7 reserved on the drum 3 into a shed by the picking nozzle 5, the detaining pin 4 is retracted to be separated from the drum 3.

The weft insertion control device 1 is equipped with an electronic control system comprising a first comparator 10, an encoder 11 for detecting the phase of the loom, namely, the angular position of the crankshaft of the loom, an adjustable timing device 12, a driver 13 for driving the solenoid 9, a picking speed controller 14, an alarm device 15, an optical sensor 16 having a light emitting element and a photoelectric element, a preset counter 17, a second comparator 18, a memory 19, a read decision circuit 20, a correcting circuit 21 and an auxiliary preset counter 22. One of the input terminals of the first comparator 10 is connected to the encoder 11, while the other input terminal of the same is connected to the timing device 12. One of the output terminals of the first comparator 10 is connected to the driver 13, while the other terminal of the same is connected to both the picking speed controller 14 and the alarm device 15. The optical sensor 16 is disposed opposite to the drum 3 on the side of the picking nozzle 5 with respect to the detaining pin 4, and functions as the detecting head of a feedback correction system. The output terminal of the optical sensor 16 is connected through the preset counter 17, the second comparator 18, the memory 19, the read decision circuit 20 and the correcting circuit 21 to the input terminal of the timing device 12 and also through the auxiliary preset counter 22 to the reset signal input terminal of the memory 19.

Figure 2:
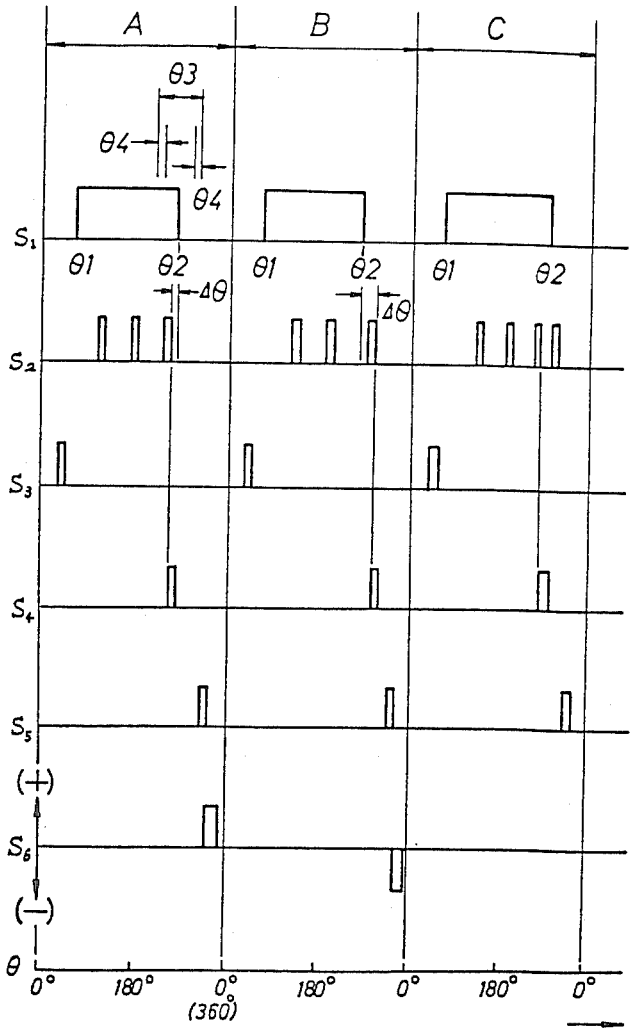
FIG. 2 is a time chart of weft insertion control operation.

The functions of the weft insertion control device 1 will be described hereinafter with reference to FIG. 2.

The rotary yarn guide 2 is rotated at a fixed speed to draw out the weft 7 from the yarn package 6 and winds the weft 7 on the drum 3. In the initial stage of the winding operation of the rotary yarn guide 2, the detaining pin 4 is brought into abutment with the circumference of the drum 3 to detain the weft 7 on the drum 3. Thus, the weft 7 having a length somewhat greater than a length necessary for one picking operation is measured and reserved on the drum 3.

While the weft 7 is being measured and wound on the drum 3 by the rotary yarn guide 2, the encoder 11 detects the phase angle $\theta$ of the loom and gives a signal corresponding to the phase angle $\theta$ to the comparator 10 once every turn of the crankshaft of the loom. The timing device 12 gives a detaining pin retracting phase signal corresponding to a weft releasing angle $\theta_1$ and a detaining pin advancing phase signal corresponding to a weft detaining angle $\theta_2$ to the first comparator 10. The first comparator 10 compares the weft releasing phase signal and the weft detaining phase signal and gives a drive signal $S_1$ of H-level to the driver 13 during a period from the weft releasing angle $\theta_1$ to the weft detaining angle $\theta_2$ to make the driver 13 drive the solenoid 9 so as to retract the detaining pin 4 during the duration of the driving signal $S_1$ of H-level. Then, the weft 7 reserved on the drum 3 is unwound from the drum 3 and is picked into a shed together with a picking fluid by the picking nozzle 5.

While the weft is being inserted into the shed, the optical sensor 16 generates a detection signal $S_2$ having pulses corresponding to the number of winds of the weft 7 unwound from the drum 3. Suppose that the number of winds of the weft 7 required for one cycle of the picking operation is three, the detection signal $S_2$ has three pulses for normal picking operation. On the other hand, prior to the weft picking operation, the preset counters 17 and 22 and the memory 19 are initialized in a state "O" by a reset signal $S_3$. The preset counter 17 counts the pulses of the detection signal $S_2$ during the weft picking operation and gives a comparison command signal $S_4$ to the second comparator 18 upon the count of the third pulse, namely, at a moment when the last wind of the weft 7 on the drum 3 is unwound. The second comparator 18 receives from the comparator 10 the signal $S_1$ which is a pulse having at the weft detaining angle $\theta_2$ its falling edge, compares the weft detaining angle $\theta_2$ and the phase of the comparison command signal $S_4$ once every cycle of the weaving motion of the loom, and then generates a correction angle signal $\Delta\theta$ corresponding to the angular difference between the weft detaining angle $\theta_2$ and the phase of the comparison command signal $S_4$. The correction angle signal $\Delta\theta$ is stored in the memory 19. Upon the completion of the picking operation, a read signal $S_5$ is given to the read decision circuit 20. Then, the read decision circuit 20 reads the correction angle signal $\Delta\theta$ from the memory 19 and gives the same to the correcting circuit 21. The correcting circuit 21 averages the correction angle signals $\Delta\theta$ once each time a fixed number of cycles of the weaving operation of the loom elapse, and then generates a digital or analog correction signal $S_6$ on the basis of the average value of the correction angle signals $\Delta\theta$, to correct the weft detaining angle $\theta_2$ of the timing device 12 so that the angular difference of the weft detaianing angle $\theta_2$ from the phase of the comparison command signal $S_4$ is reduced to zero, to advance or delay the weft detaining phase. In this embodiment, the correcting circuit 21 averages the correction angles to avoid the sudden change of the control mode, however, this averaging procedure may be omitted when the correction is required for every cycle of the weaving operation. When the loom operates at a high speed and the action of the components, such as the solenoid 9, tends to be delayed, the weft detaining phase is advanced relative to an appropriate phase by an amount corresponding to a expected delay time in expectation of the delayed action of those components.

Accordingly, the reference weft detaining angle set at the start of the weaving operation is corrected momentarily as the weaving operation continues and, thereafter, the corrected weft detaining angle is renewed according to the variation of the weaving condition. The weft releasing angle $\theta_1$ is decided previously so that the picking operation is effected when an optimum shed is formed, and hence the weft releasing angle $\theta_1$ need not be corrected. The timing device 12 gives signals respectively representing a phase range angle $\theta_3$ defining the range of correction of the weft detaining angle and a phase range angle $\theta_4$ defining the alarm range in the range of correction of the weft detaining angle, to the first comparator 10. The weft detaining angle $\theta_2$ is regulated automatically within the phase range angle $\theta_3$ defining the range of correction.

When the weft detaining angle $\theta_2$ approaches the limit zone, namely, the phase range angle $\theta_4$ of the alarm range, the first comparator 10 gives a signal $S_0$ corresponding to the present weft detaining angle to the alarm device 15 and to the picking speed controller 14. Upon the reception of the signal $S_0$, the alarm device 15 gives a sound or light alarm to inform the operator of the abnormal weaving condition, while the picking speed controller 14 corrects the picking speed to a predetermined value, for example, by enhancing or reducing the pressure of the pressurized picking fluid to be supplied to the picking nozzle 5. In FIG. 2, a cycle A corresponds to the operation for advancing the weft detaining angle $\theta_2$, while a cycle B corresponds to the operation for delaying the weft detaining angle $\theta_2$.

The weft insertion control device 1 operates in the manner as described hereinbefore when the optical sensor 16 provides a normal detection signal, namely, a signal having three pulses in this embodiment. The weft insertion control device 1 operates in the following manner when the optical sensor 16 provides a detection signal having pulses other than three pulses, namely, two or less pulses or four or more pulses.

When the optical sensor 16 provides, for example, two pulses in one cycle of the picking operation, the present counter 17 does not provide the comparison command signal $S_4$. Consequently, the second comparator 18 does not operate during this picking cycle, and hence the correction angle signal $\Delta\theta$ is not given to the memory 19. In this case, the above-mentioned weft detaining angle correcting operation is not executed. Thereafter, the preset counters 17 and 22 and the memory 19 are initialized by the reset signal $S_3$ for the weft detaining angle correcting operation in the next picking cycle.

Suppose that the optical sensor 16 has provided a detection signal having four pulses. Then, the preset counter 17 gives the comparison command signal $S_4$ to the second comparator 18 at a wrong time. Consequently, the memory 19 stores the wrong information. However, since the count of the auxiliary preset counter 22 is set at "4", the auxiliary preset counter 22 gives an auxiliary reset signal $S_7$ to the memory 19 upon the reception of the detection signal $S_2$ having four pulses from the optical sensor 16, and thereby the contents of the memory 19 is erased. Accordingly, the read decision circuit 20 is unable to read any signal from the memory 19, and thereby erroneous control operation is surely avoided. Naturally, the same control procedures are carried out also when the optical sensor 16 provides a detection signal having more than four pulses. When the optical sensor 16 gives a detection signal having eight pulses or more to the auxiliary preset counter 22 in one picking cycle, the memory 19 is reset twice or more, which does not matter to the weft insertion control operation. Such a case is shown by cycle C in FIG. 2.

Although the invention has been described in its preferred embodiment with a certain degree of particularity, it is to be understood that many changes and variations are possible in the invention without departing from the scope and spirit thereof.

What is claimed is:

1. A weft insertion control method for keeping constant the length of the weft picked in each pick by controlling the operation of a weft inserting device which measures and reserves a weft by winding the weft on a stationary measuring and reserving drum by means of a rotary yarn guide, releases the weft from and detains the same on the measuring and reserving drum by reciprocating a detaining pin relative to the measuring and reserving drum, and picks the weft wound and reserved on the measuring and reserving drum using a picking nozzle, which comprises the steps of:

(a) controlling a detaining pin, including the steps of comparing a present weft releasing angle and a reference weft detaining angle with the phase angle of the loom, retracting the detaining pin when the phase angle of the loom is at the weft releasing angle to separate the detaining pin from the circumference of the measuring and reserving drum, and advancing the detaining pin when the phase angle of the loom is at the reference weft detaining angle to bring the detaining pin into abutment with the circumference of the measuring and reserving drum;

(b) detecting the number of winds of the weft removed from the measuring and reserving drum;

(c) comparing the phase angle where the last wind of the weft is unwound from the measuring and reserving drum with the reference weft detaining angle to obtain the angular difference therebetween; and (d) correcting the reference weft detaining angle on the basis of the angular difference obtained in the comparing step so that the angular difference is reduced to zero.

2. The weft insertion control method according to claim 1, including the steps of determining whether the corrected reference weft detaining angle is within a predetermined angular range, and controlling the picking speed when the corrected reference detaining angle is outside the predetermined range so as to control and keep constant the length of the weft being picked in each pick.

3. A weft insertion control device for keeping constant the length of the weft picked in each pick by controlling the operation of a weft inserting device which measures and reserves a weft by winding the weft on a stationary measuring and reserving drum by means of a rotary yarn guide, releases the weft from and detains the same on the measuring and reserving drum by reciprocating a detaining pin relative to the measuring and reserving drum, and picks the weft wound and reserved on the measuring and reserving drum using a picking nozzle, which comprises:

an adjustable timing device for setting a weft releasing angle and a reference weft detaining angle;

phase angle detecting means for detecting the phase angle of the loom;

a first comparator which receives signals respectively corresponding to the weft releasing angle and the reference weft detaining angle from the timing device and compares these signals with the phase angle of the loom from the phase angle detecting means, and then provides a driving signal for driving the detaining pin;

a detector which detects the number of winds of the weft removed from the measuring and reserving drum and procudes a corresponding number of pulses;

a preset counter which counts the number of pulses from the detector and provides a comparison command signal upon the count of the last wind of a predetermined and preset number of winds;

a second comparator which compares the comparison command signal from the present counter and the reference weft detaining angle and provides a correction angle signal corresponding to the angular difference between the comparison command signal and the reference weft detaining angle;

a memory which stores the correction angle signal from the second comparator; and a read decision circuit which reads the contents of the memory and corrects the timing device so that the angular difference is reduced to zero.

4. A weft insertion control device according to claim 3, wherein an auxiliary preset counter is provided to invalidate the output signal of the second comparator when the detector provides a detection signal having a number of pulses greater than a predetermined number of winds of the weft necessary for one cycle of picking operation.

5. A weft insertion control device according to claim 3, wherein the corrected weft detaining angle is within a predetermined control range of angular values, wherein the control range has first and second portions at opposite ends thereof which together serve as an alarm range, and wherein the first comparator gives a feedback signal to a picking speed controller when the corrected weft detaining angle is within the alarm range of the control range.

* * * * *

UNITED STATES PATENT AND TRADEMARK OFFICE

CERTIFICATE OF CORRECTION

PATENT NO. : 4 702 285

DATED : October 27, 1987

INVENTOR(S) : Katsuhiko SUGITA

It is certified that error appears in the above-identified patent and that said Letters Patent is hereby corrected as shown below:

Column 7, Line 16; Change "procudes" to ---produces---.

Signed and Sealed this

Twenty-sixth Day of April, 1988

*Attest:*

DONALD J. QUIGG

*Attesting Officer*

*Commissioner of Patents and Trademarks*